United States Patent [19]

Schlosser

[11] 4,394,552

[45] Jul. 19, 1983

[54] FLIP-ACTION GUARD AND POSITION INDICATOR FOR PUSH-TO-ACTUATE AND PUSH-TO-RELEASE SWITCH

[75] Inventor: Mark S. Schlosser, Seattle, Wash.

[73] Assignee: Korry Manufacturing Co., Seattle, Wash.

[21] Appl. No.: 325,139

[22] Filed: Nov. 27, 1981

[51] Int. Cl.[3] ..... H01H 13/04

[52] U.S. Cl. ..... 200/61.62; 200/153 J; 200/313; 200/333

[58] Field of Search ..... 200/61.62, 308, 314, 200/333, 334, 72 R, 50 A, 50 C, 61.63, 153 J, 312, 313

[56] References Cited

U.S. PATENT DOCUMENTS 1,746,724 2/1930 Wexberg ..... 200/308

1,884,000 10/1932 Lewis ..... 200/50 A

*Primary Examiner*—A. T. Grimley

*Assistant Examiner*—Morris Ginsburg

*Attorney, Agent, or Firm*—Christensen, O'Connor, Johnson & Kindness

[57] ABSTRACT

A flip cover functioning as a protective guard preventing accidental switch actuation and as a mechanical indicator of switch position. Cooperating slidable abutment elements on the push-button head of the switch and on the flip cover maintain the flip cover in outwardly tilted position with the switch latched in actuated position. With the switch pushed into latch-releasing position the abutment elements are relatively so positioned as to permit the switch to return to its released or unactuated position, the abutment elements slipping past each other to permit return of the flip cover into its normal guard position.

8 Claims, 6 Drawing Figures

Fig. 1.
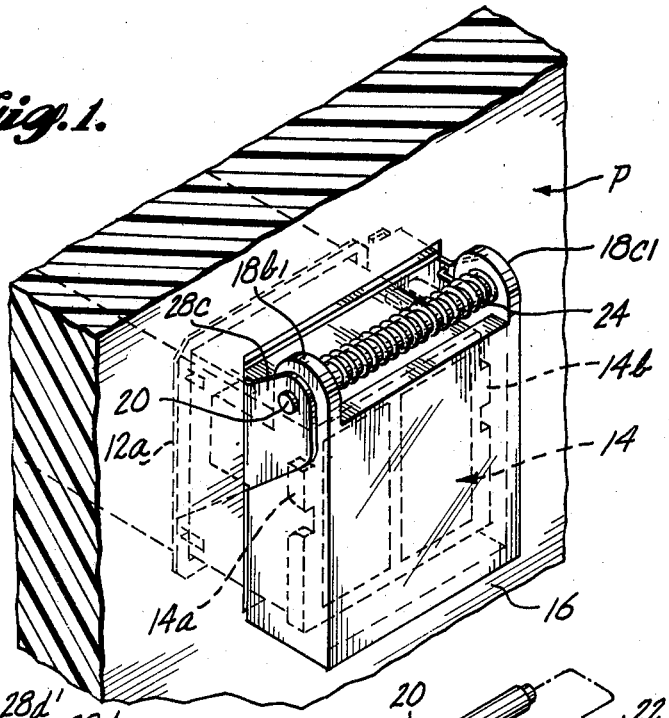
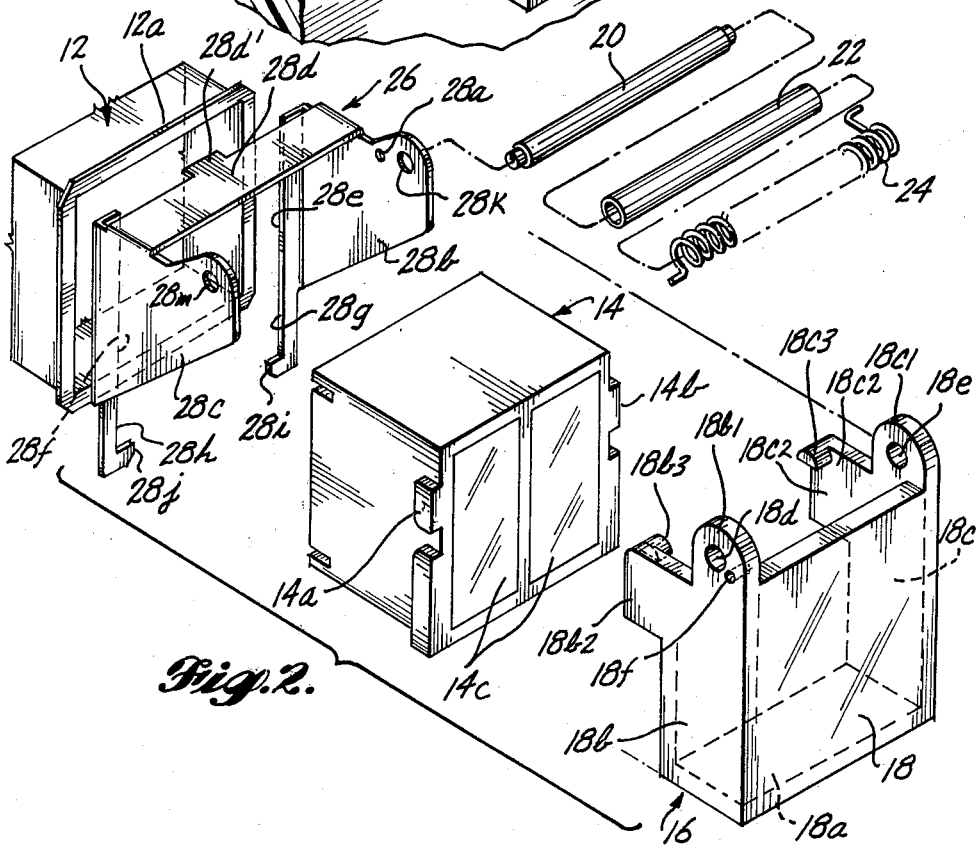
Fig. 2.

FLIP-ACTION GUARD AND POSITION INDICATOR FOR PUSH-TO-ACTUATE AND PUSH-TO-RELEASE SWITCH

BACKGROUND OF THE INVENTION

This invention relates to improvements in push-to-actuate and push-to-release switch devices such as are used in the control panels of modern-day aircraft and in other applications. The invention is herein illustratively described by reference to the presently preferred embodiment thereof; however, it will be recognized that certain modifications and changes therein with respect to details may be made without departing from the essential features involved.

In the complex control panels of aircraft and other systems, it is often imperative for the person monitoring the system to be able to observe instantly the settings of various critical switch elements. These are usually indicated by lighted displays, each switch element having a push-button head with an internal lamp illuminated in the latched or actuated position of the switch. If the lamp is burned out, however, and yet the switch is actuated, the pilot or operator will not readily observe the actuated condition of the switch. In addition, if the switch is off to the side from the central point of observation at any moment it may not be readily apparent to the observer whether the switch is actuated or released.

The present invention is broadly directed to an improved mechanical indicator and protective guard for push-to-release and push-to-actuate switches, and which at all times will reliably indicate to the operator the operating state of the switch independently of whether its indication lamp is working and without necessity for direct frontal close-up observation.

SUMMARY OF THE INVENTION

In accordance with this invention a flip cover serving as a protective guard and mechanical indicator of switch position is hingedly mounted adjacent an edge, preferably the upper edge, of the mounting panel aperture in which the push-button switch is placed. The combined guard and position indicator cooperates with the push-to-actuate and push-to-release switch push-button head to cover the latter in its released (outer) position at the front of the switch panel and to be held in outwardly deflected position by the push-button head in the latter's latched (intermediate) position, its position with the switch actuated. Interengageable sliding abutments on the push-button head and on the flip cover, controlling the positioning of the flip cover as a function of switch position, slip past each other to permit the cover to assume its normal protective guard position when it presses the push-button head into its innermost, latch-releasing position.

BRIEF DESCRIPTION OF DRAWINGS

FIG. 1 is a front isometric view of the flip cover or switch guard and position indicator mechanism in place with an associated push-button switch in its released position.

FIG. 2 is an exploded isometric illustrating the flip cover mechanism together with portions of an associated push-to-actuate and push-to-release switch assembly and mounting panel.

DETAILED DESCRIPTION OF ILLUSTRATED PREFERRED EMBODIMENT

Figure 3:
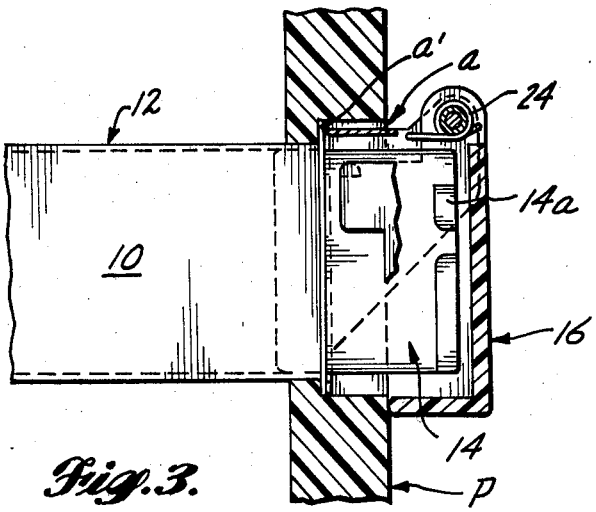
FIGS. 3, 4, 5, and 6 are longitudinal vertical sectional views respectively showing the flip cover: (3) with the push-button switch in released position; (4) with the flip cover raised and an operator's finger applied to initiate switch actuation from release position; (5) with the push-button switch in actuated, latched (swich actuated) position and the flip cover positioned correspondingly to flag the fact; and, (6) with the operator's finger shown applied to the flip cover to press the push-button head inwardly into latch-releasing position in which, when that position is reached, cooperating flip cover abutments and push-button head abutments in sliding engagement with each other will slip past each other so as to permit the push-button head to spring back into its switch-released position (FIG. 3).

The drawings do not attempt to depict the conventional or otherwise suitable details of the push-button switch assembly 10 and how its tubular support casing 12 is secured in place in a framing aperture in mounting panel P. The switch assembly's push-button head 14 slidably received in casing 12 has a forwardmost switch-released position (FIG. 3), an intermediate latched, switch-actuated position (FIG. 5) and in innermost alternatingly and transitory latch-engaging and latch-releasing position. The push-button head is pressed inwardly into this latter (innermost) position manually in order to trigger the scale-of-two automatic latching mechanism when the switch is to be latched (actuated) or unlatched (released). Scale-of-two latching devices suitable for the purpose are well known in this art and are therefore not shown herein. In the usual application, push-button head 14 has one or more indicator indicia windows **14*c*** internally lamp-illuminated by switch terminal contact with the switch in its actuated position (FIG. 4). Here again, switch details and lamp details are or may be conventional, so are omitted from the drawing.

A component central to this invention is the flip cover 16 that serves as a switch guard and position indicator. This is shown comprising a flat transparent resilient synthetic plastic plate 18 flanged inwardly (i.e. toward the mounting panel P) at its edges by a bottom flange **18*a* and opposite side flanges 18*b* and 18*c* all molded integrally with the plate. The respective side flanges have upward extension ears 18*b*1 and 18*c*1 with mutually transversely aligned holes 18*d* and 18*e* into and through which the opposite ends of a pivot shaft 20 can be snapped and retained by forced spreading of the ears to accomodate the intermediate length of the shaft between them. Between ears 18*b*1 and 18*c*1 shaft 20 is surrounded by a tubular sleeve 22 and that in turn by a helical spring 24 having one end received in a small aperture 18*f* in ear 18*b*1. The opposite end of the spring is lodged in a small aperture 28*a* in one side plate 28*b* of a resilient sheet metal flip cover support yoke 26. Side plate 28*b* and a similar opposite side plate 28*c* are maintained in spaced parallel relationship by a connecting bridging plate 28*d*. The inner upright edges of side plates 28*b* and 28*c* have elongated upright flanges 28*e* and 28*f* projecting toward each other in a common tranverse plane. These flanges have respective narrow downward extension fingers 28*g* and 28*h* which can be sprung apart. They are sprung apart, when installing the support yoke 26, by forcibly slipping the fingers down along the opposite sides of tubular housing 12 until their inwardly jutting locking tips 28*i* and 28*j* snap inwardly past and lodge beneath the lower corners of the housing 12. At that point the flanges 28e and 28f abut and are retained immediately behind the collar flange 12a on the forward end of tubular casing 12. A stop limiting downward installing movement of the support yoke on housing 12 is provided by a projection 28d' at the rear edge of bridging plate 28d**.

Figure 4:
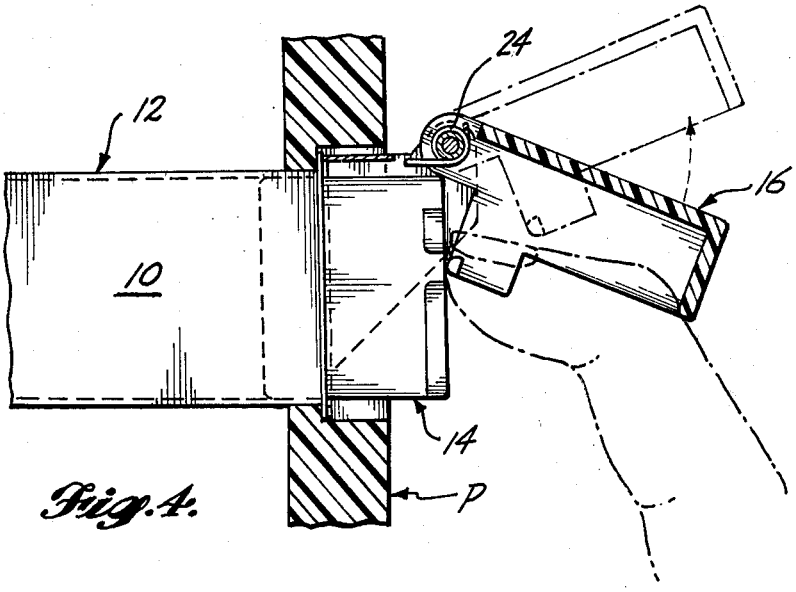

Conventional or other suitable securing means (not shown) holds the casing 12 in the panel aperture a projecting inwardly from the rear face of the panel P and with flanges 28e and 28f clamped in fixed position between casing flange 12a and ledge a' formed in panel aperture a (FIG. 3 et seq.). Thus held in fixed position, yoke side plates 28b and 28c project forwardly to and beyond the front face of panel P where their upper forward corners having mutually aligned apertures 28k and 28m receive and retain the ends of shaft 20, the end-reduction shoulders on the shaft bearing against the inside faces of plates 28b and 28c.

Spring 24 yieldably urges hinged guard/indicator 16 downwardly toward its normal or retracted position, a position which it occupies with the push-button head 14 in the switch-released (unlatched) position (FIGS. 1 and 3).

In addition to upwardly directed extensions forming ears 18b1 and 18c1, cover side flanges 18b and 18c have inwardly directed mutually parallel extensions 18b2 and 18c2. These respectively carry sliding contact abutments 18b3 and 18c3 that project in mutual alignment toward each other and have transversly convexly rounded tops. The spacing between the abutments 18b3 and 18c3 slightly exceeds the outside width of the parallel sided push-button head 14.

Figure 5:
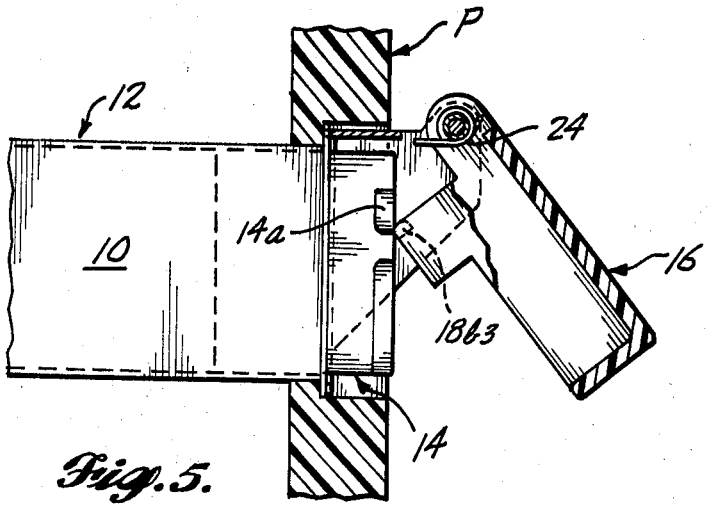
Figure 6:
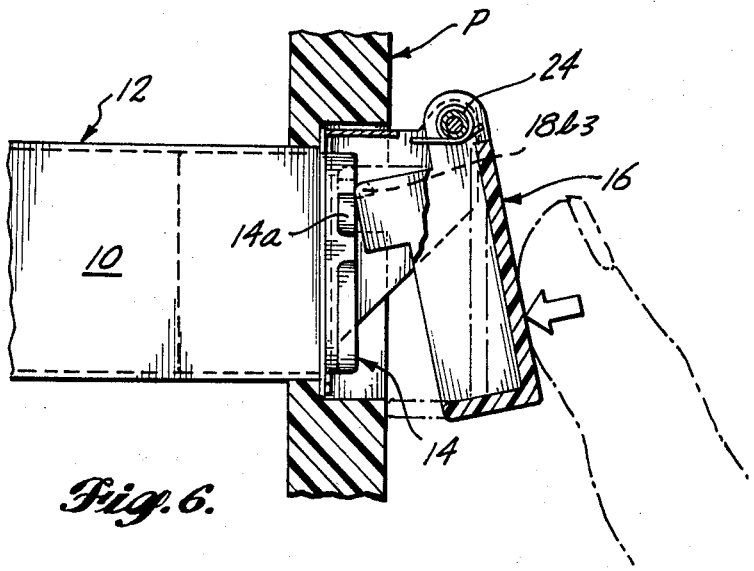

At its forward end push-button head 14 has transverse side flanges 14a and 14b the forward faces of which serve as abutments slidably engageable by the respective abutments 18b3 and 18c 3 with the cover 16 and push-button head 14 in certain relative positions (e.g., FIGS. 5 and 6). When the push-button head is in its released position, the abutments 18b3 and 18c3 having previously slipped past the upper ends of abutment flanges 14a and 14b as later explained, the flip cover 16 is maintained by its return spring 24 in the flip cover's closed or normal position (FIGS. 1 and 3). The upper extremeties of abutment flanges 14a and 14b are so located inwardly and downwardly relative to the flip cover pivot shaft 20 that inward/downward swinging of the flip cover to the point it is pressing the push-button head 14 into its innermost (latch-releasing) position (FIG. 6) allows the cover to snap into its fully closed rest position shown in FIG. 3. The lower extremeties of the abutment flanges 14a and 14b are so located as to allow the abutments 18b3 and 18c3 to flip forwardly past them when the flip cover 16 is being raised forwardly and upwardly from its closed position (FIG. 3) into a position (FIG. 4) affording access to the push-button head 14 for actuation of the switch.

Hence the vertical length of each abutment flange (i.e., the distance between its positionally defined extremeties described above) provides a bearing contact surface for abutments 18b3 and 18c3 which holds the flip cover 16 in outwardly inclined indicating position with the switch in its actuated (latched) position (FIG. 5).

It will also be seen that with the push-button head in actuated (latched) position, either the cover or the operator's finger (with the cover raised) can be used to press the push-button head into latch-releasing position. In either event, the cover 16 and push-button head go to the positioned relationship of FIG. 3.

Flip cover 16 therefore, serves to protectively cover and guard the push-button switch against accidental actuation by inadvertent leaning or pressing against the push-button head 14. It also functions as a mechanical indicator signalling switch position to the operator, such as an aircraft pilot, copilot, or navigator who may not have a face-on view of the push-button head or who may have such a view but may fail to note its position because its internal indicating lamp is burned out. Transparency of the flip cover panel permits any illuminated indicia appearing on the face of the push-button head to be seen through the flip cover either in the released position of the switch (FIG. 3) or in its actuated position (FIG. 5).

It will be appreciated that the invention, shown and described in its presently preferred form, is subject to design variations within the scope thereof as defined by the claims that follow.

The embodiments of the invention in which an exclusive property or privilege is claimed are defined as follows:

1. A switch assembly including push-to-latch and push-to-release switch means adapted to be mounted in a mounting panel, said switch means including a push-button head manually accessible from the front of the mounting panel and guided for lineal reciprocation transversely to the panel through a range including an intermediate latched position and extending between an outer, released position of said assembly and an inner, latch-releasing position thereof, a flip cover, means for hingedly mounting said flip cover adjacent to said push-button head in fixed relation to the panel so as to swing about an axis transverse to such lineal reciprocation between an inner, limiting guard position overlying said head in its released position, and a fully outwardly extending position clearing the push-button head for manual access to said head, mutually interengageable abutment elements respectively carried by said flip cover and said push-button head disengaged in the released position of the push-button head and relatively positioned, firstly, to pass one another without engaging one another accompanying swinging of said flip cover to said fully outwardly extending position with said head in its released position, secondly, to engage one another with the flip cover maintained thereby partially outwardly extended with the head in its latched position, and thirdly, to engage one another in sliding contact terminated by one such abutment element passing out of engagement with the other accompanying movement of the flip cover inwardly and conjoint movement of the push-button head inwardly beyond latched position of the head, thereby to permit return of the flip cover to its guard position as the push-button head approaches latch-releasing position.

2. The combination defined in claim 1, wherein the flip cover includes inwardly directed side flange members disposed transverse to the panel and lying adjacent to corresponding sides of the push-button head in its released position.

3. The combination defined in claim 2 wherein the flip cover has two opposite side flange members carrying abutment elements projecting therefrom in mutual alignment parallel to the hinge axis of the flip cover, and wherein the push-button head has complemental abutment elements interengageable with said flange member abutment elements.

4. The combination defined in claims 1, 2, or 3 wherein the hingedly mounted flip cover includes spring means yieldably urging the flip cover toward its guard position.

5. The combination defined in claim 1, wherein the flip cover is hingedly mounted to swing in a plane generally parallel to opposite sides of the head and includes a pair of inwardly directed flange members on opposite sides thereof accommodating the push-button head between them.

6. The combination defined in claim 5, wherein such flange members carry respective mutually aligned projections serving as the abutment elements for the flip cover and wherein the push-button head abutment elements on respectively opposite sides thereof are slidably interengageable with said projections.

7. The combination defined in claims 1, 5 or 6 wherein the flip cover hinged mounting means includes a spring yieldably urging the flip cover toward its guard position.

8. The combination defined in claims 1, 5 or 6 wherein the flip cover hinged mounting means includes a spring yieldably urging the flip cover toward its guard position, and wherein the hinged mounting means comprises a frame yoke having parallel side plates hingedly supporting the flip cover and interconnected by a bridging plate, said yoke closely embracing the push-button head and itself, in turn, being mountable within a panel aperture accomodating said switch assembly.

* * * * *